US006561252B2

(12) United States Patent
Anderson et al.

(10) Patent No.: US 6,561,252 B2
(45) Date of Patent: May 13, 2003

(54) CORD-DRIVEN DRUM

(75) Inventors: Richard Anderson, Whitesville, KY (US); Steven R. Haarer, Whitesville, KY (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 09/870,123

(22) Filed: May 30, 2001

(65) Prior Publication Data

US 2002/0003030 A1 Jan. 10, 2002

Related U.S. Application Data

(60) Provisional application No. 60/209,700, filed on Jun. 5, 2000.

(51) Int. Cl.[7] ..... E06B 9/38

(52) U.S. Cl. ..... 160/176.1 R; 160/177 R; 160/177 V; 74/501.6; 74/505

(58) Field of Search ..... 160/176.1 R, 176.1 V, 160/177 R, 177 V, 178.1 R, 178.1 V; 242/364, 365.3, 365.6, 366.2, 366.3; 254/333; 74/500.5, 501.5 R, 480 B, 459

(56) References Cited

U.S. PATENT DOCUMENTS

| | | | | |
|---|---|---|---|---|
| 2,269,854 | A | | 1/1942 | Kuyper |
| 2,334,132 | A | | 11/1943 | Sherwood |
| 2,580,252 | A | | 12/1951 | Stuber et al. |
| 2,591,011 | A | * | 4/1952 | Rose et al. |
| 2,627,833 | A | * | 2/1953 | Schroeder |
| 2,855,991 | A | * | 10/1958 | Loucony |
| 2,918,968 | A | | 12/1959 | Schultz |
| 2,951,460 | A | * | 9/1960 | Pierson |
| 3,782,661 | A | * | 1/1974 | Deniega et al. |
| 3,858,830 | A | * | 1/1975 | Deniega et al. |
| 4,020,707 | A | * | 5/1977 | Cuniberti |
| 5,297,608 | A | | 3/1994 | Rap et al. |
| 6,129,131 | A | * | 10/2000 | Colson |

FOREIGN PATENT DOCUMENTS

| | | |
|---|---|---|
| CA | 2206932 | 12/1997 |
| JP | 8-318735 | 12/1996 |

* cited by examiner

*Primary Examiner*—Blair M. Johnson
(74) *Attorney, Agent, or Firm*—Theresa Fritz Camoriano; Guillermo Camoriano; Camoriano and Associates

(57) ABSTRACT

A drum is driven by cord ends, which are wrapped onto the drum. The drum sits in a housing with slotted openings which are opposite each other and in a plane which is substantially tangent to the surface of the drum. The cord ends exit the housing through said slotted openings such that, even if both ends of the cord are pulled at the same time, the force is directed so that it does not cause, or minimizes, deflection of the drum.

28 Claims, 11 Drawing Sheets

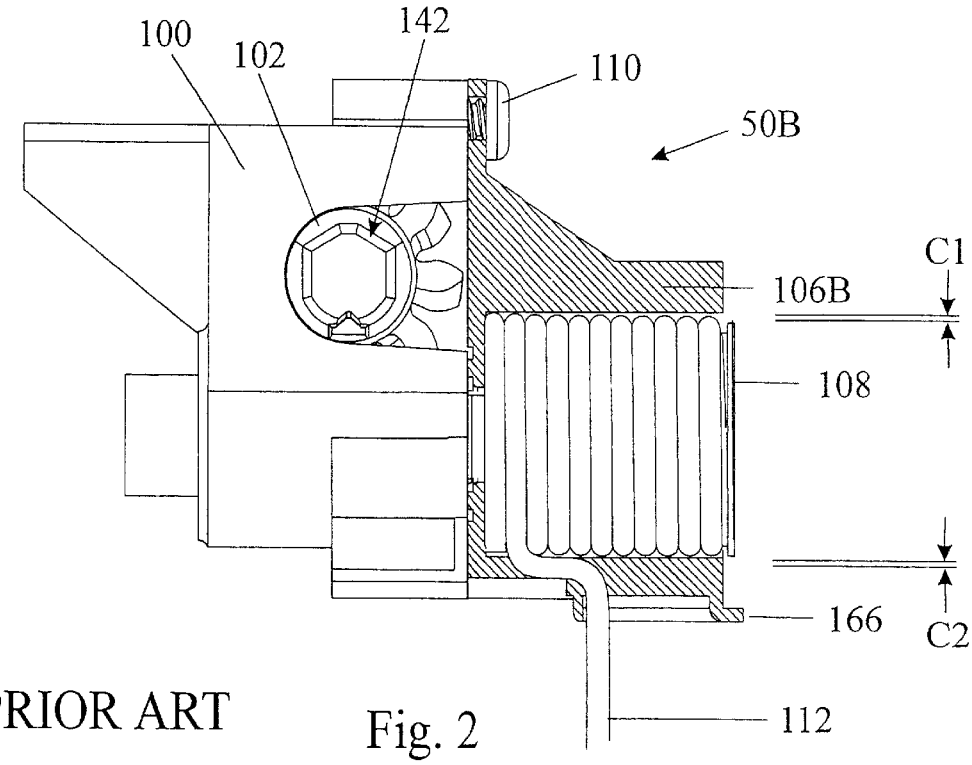
PRIOR ART Fig. 2
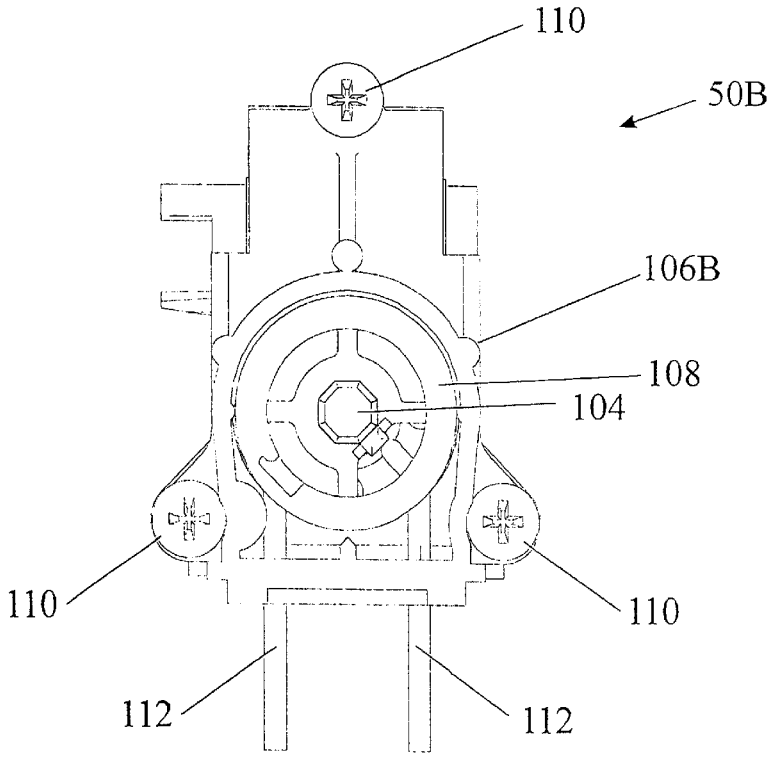
PRIOR ART Fig. 3

CORD-DRIVEN DRUM

This application claims priority from U.S. Provisional Application Ser. No. 60/209,700, filed Jun. 5, 2000.

BACKGROUND OF THE INVENTION

The present invention relates to a cord-actuated drum, which drives a mechanical system. The preferred embodiment was designed for use in a cord tilter used for opening and closing coverings for architectural openings such as Venetian blinds, pleated shades, and other blinds and shades. Typically, a blind transport system will have a top head rail, which both supports the blind and hides the mechanisms used to raise and lower or open and close the blind. Such a blind system is described in U.S. Pat. No. 2,614,623, "Nelson", which is hereby incorporated by reference. The raising and lowering is done by a lift cord attached to the bottom rail (or bottom slat). The tilting of the slats to open and close the blind is typically accomplished with ladder tapes (and/or tilt cables). The lift cords (in contrast to the tilt cables) typically run through holes in the middle of the slats and are connected to the bottom rail.

A prior art cord tilter is shown in Canadian patent application 2,206,932, which is hereby incorporated by reference, and in FIGS. 2 and 3 of this application. Cord tilters for window covering products typically have one thing in common, and that is that a cord wraps around a driving drum with opposite ends of the cord extending vertically downwardly from opposite sides of the drum. The ends of the cord may be two loose ends or they may be a closed loop. Most cord drums are wrapped from one end of the drum to the other end of the drum with a first cord end such that when this first cord end is pulled to unwind, a second opposite cord end is wrapped onto the cord drum. The first and second cord ends may be on a single cord, or they may be ends of two separate cords. Also, the cord may be a continuous loop, so that the two cord ends are not technically ends at all. Typically, there is a clearance of less than two cord diameters between the drum and the housing surrounding the drum, such that only one cord diameter can fit between the drum and the housing, and the housing urges the cord to track properly, preventing over-wraps which would cause the cord to tangle and bind against the housing. However, over-wraps may still occur for a number of reasons. For example, when the cord is in tension, the diameter of the cord actually may reduce from its diameter in a normal condition, so two cords may be able to pass each other even if the clearance between the housing and the drum is less than two normal cord diameters. Also, the cord wraps best onto the drum when it enters the drum at right angles to the axis of rotation. As the angle of entry moves away from right angles and approaches a direction that is more parallel to the axis of rotation, the likelihood for an overwrap condition increases.

If the user tends to hold on to both cord ends at the same time (creating a back pressure on the cord end that is being wound up while pulling downwardly on the cord end that is being unwound), the likelihood for over-wrap increases. When pulling on both cord ends simultaneously, a much greater force is exerted on the operating system than when pulling on a single cord end, because one must overcome not only the required system inertia to cause the tilting action, but one must also overcome the opposing force being placed on the upward-moving cord end.

This extra force puts greater tension on the cords, which tends to reduce the diameter of the cord, so that two cord portions may be able to cross over in a space, even if the clearance is less than two normal cord diameters.

This extra force also causes a much greater deflection in the componentry than would otherwise be present, thus causing a larger clearance to occur between the housing and the top of the driving drum, which then increases the likelihood that an over-wrap condition will occur. At the same time, the clearance between the housing and the bottom of the drum is reduced, which may lead to pinching and binding of the cord between the housing and the drum.

In addition, the backward pressure on the upward moving cord end inhibits that cord end from following its natural circuitous path in its upward or winding process.

SUMMARY OF THE INVENTION

A primary objective of the present invention is to provide an improved cord drive mechanism which addresses and solves the drawbacks of the mechanisms found in the prior art.

The preferred embodiments shown herein change the exit point and direction of the two cord ends as they exit the driving drum in order to improve the angle at which the cord ends enter into contact with the drum and in order to have the two cord ends apply force to the drum in opposite directions, so that, if both cord ends are pulled at the same time, the forces cancel each other out rather than adding together to cause deflection of the drum relative to its housing.

Furthermore, because deflection of the drum relative to the housing is greatly reduced or eliminated, the clearances between the drum and the housing can be reduced, by design, to the level of 1.1 to 1.6 cord diameters, thus encouraging the cord to be initially laid down on the drum in the proper position without any over-wrap, and maintaining cord placement on the drum even in conditions where the cord may become completely relaxed.

While the embodiments of the present invention described below show a typical horizontal Venetian blind, it should be obvious to those skilled in the art that a cord-driven drum made in accordance with the present invention may be used in a wide variety of different arrangements in which a mechanical drive is required, and the orientation of the drum may be in any direction.

BRIEF DESCRIPTION OF THE DRAWINGS

FIG. 2 is a side view, partially in section, of a cord tilter found in the prior art;

FIG. 3 is a front end view of the prior art cord tilter of FIG. 2;

DESCRIPTION OF THE PREFERRED EMBODIMENTS

Figure 1:
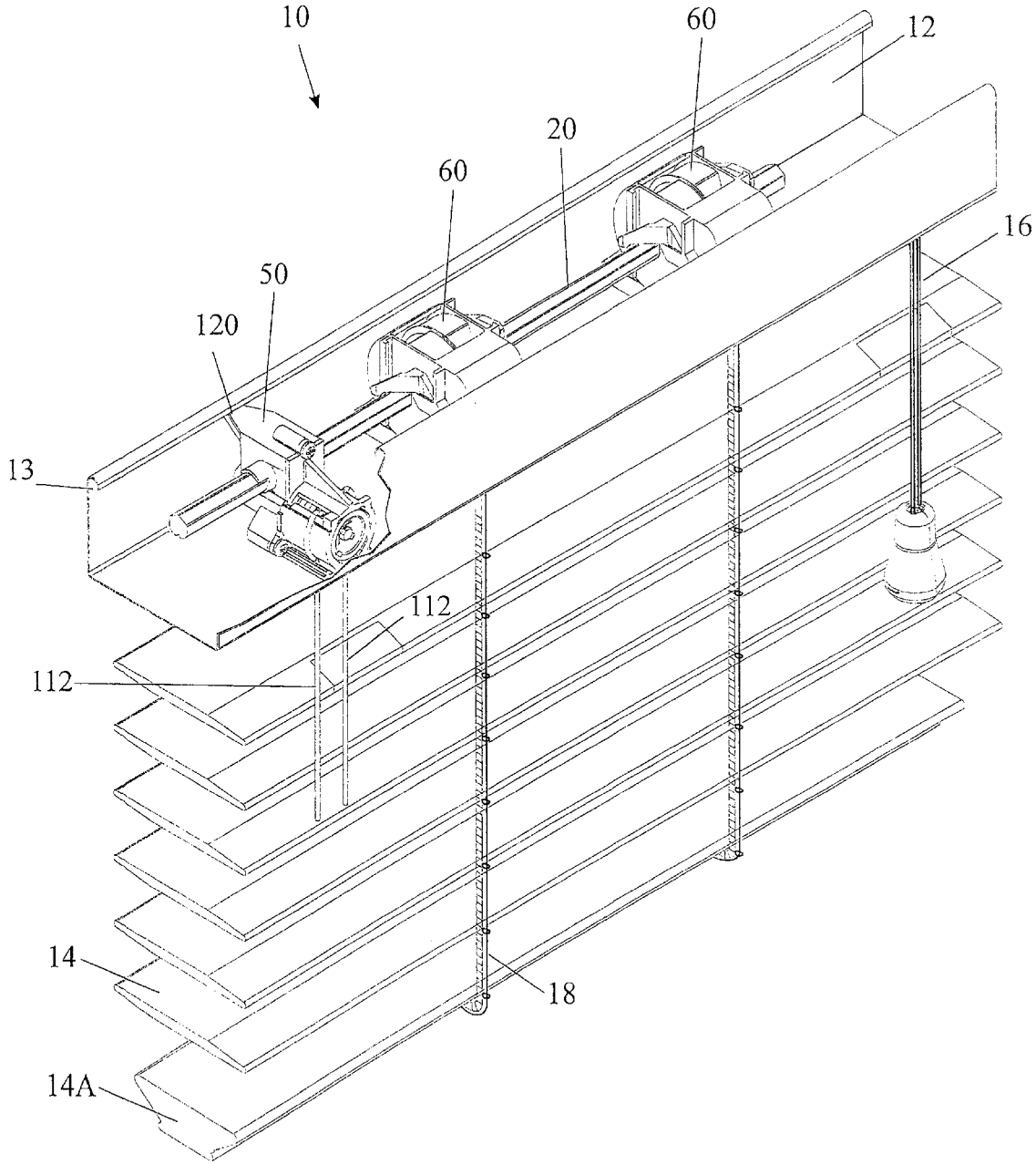
FIG. 1 is a partially broken away front perspective view of a Venetian blind including a cord tilter made in accordance with the present invention.

FIGS. 1, 1A, 4–6, 8, 8A, and 10 show a first embodiment of a cord tilter made in accordance with the present invention. Referring now to FIG. 1, the blind 10 includes a head rail 12, and a plurality of slats 14 suspended from the head rail 12 by means of tilt cables 18 and the associated cross cords which together comprise the ladder tapes. Two lift cords 16 extend through the head rail and through holes (not shown) in the slats 14 and are fastened at the bottom of the bottom slat (or bottom rail) 14A, which is heavier than the other slats 14, as is well known in the art. Inside the head rail 12 are a cord tilter module 50, two tilt modules 60, and a tilt rod 20 which interconnects the cord tilter 50 with the tilt modules 60. This cord tilter module 50 is operated by a tilt cord 112, which causes the tilt rod 20 to rotate around its longitudinal axis, which, in turn, causes the tilt modules 60 to rotate as well. This action pulls on one side or the other of the tilt cables 18 in order to rotate the slats 14 to the open or closed position.

Figure 4:
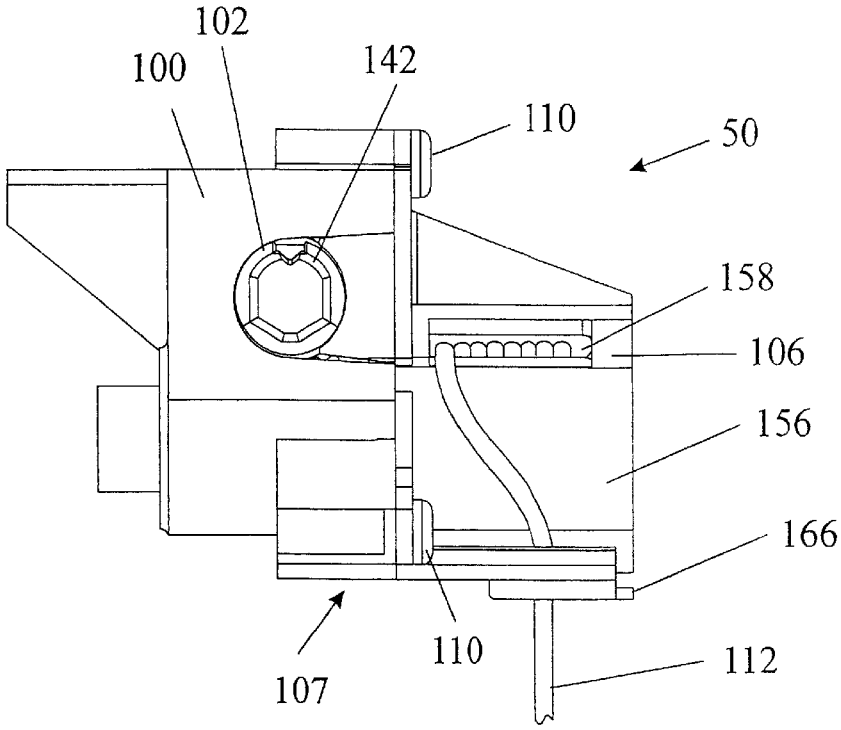
FIG. 4 is a side view of the cord tilter of FIG. 1.
Figure 5:
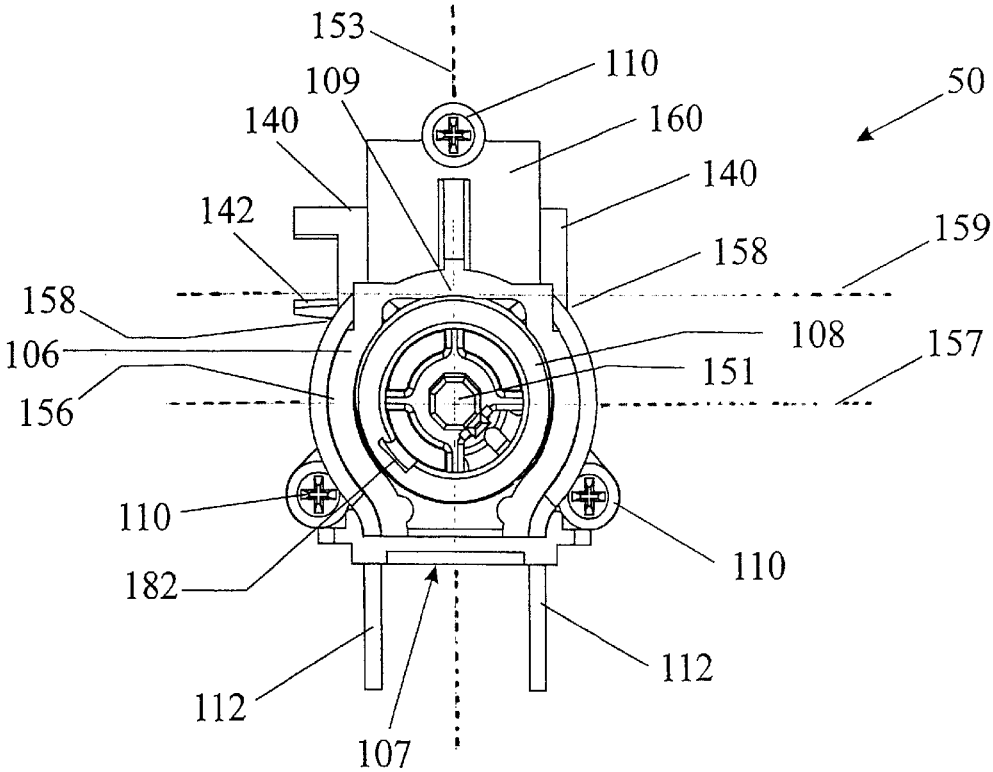
FIG. 5 is a front end view of the cord tilter of FIG. 4.
Figure 6:
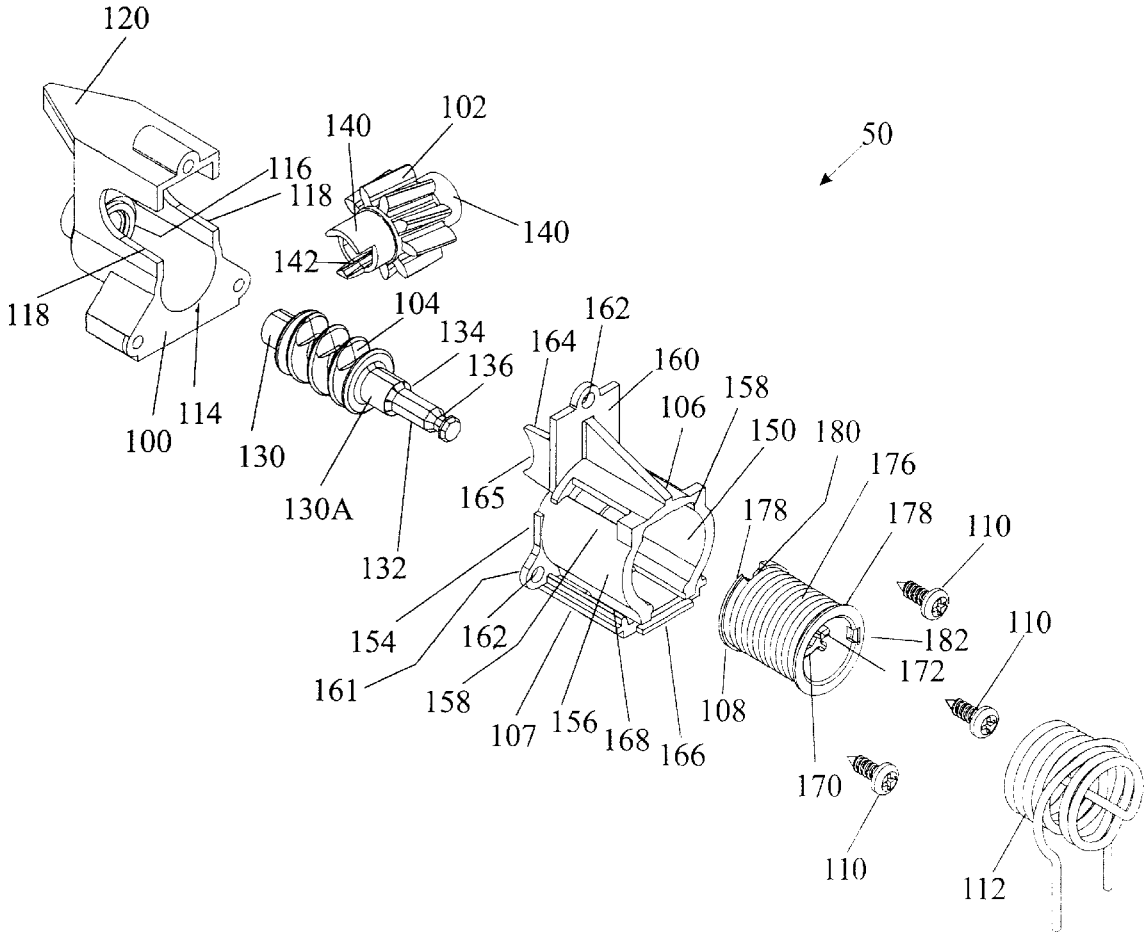
FIG. 6 is an exploded front perspective view of the cord tilter of FIG. 4.

FIG. 6 shows an exploded perspective view of the improved cord tilter 50, which includes an anvil shaped housing 100, a spur gear 102, a worm gear 104, a housing cover 106, a threaded drum 108, three fasteners 110, and a tilt cord 112. (Additional views of this cord tilter 50 are shown in FIGS. 4–5.)

The anvil shaped housing 100 has a longitudinal, cylindrical cavity 114 designed to accommodate the worm gear 104, and a small circular recess 116 designed to support and to act as an axial stop to the shaft 130 of the worm gear 104. Thus, the worm gear 104 rides in and is cradled by the longitudinal cavity 114, with one end of the worm gear shaft 130 supported by the recess 116 of the housing 100. The other end of the worm gear shaft 130 is supported by an opening in the rear 154 of the housing cover 160.

Figure 1A:
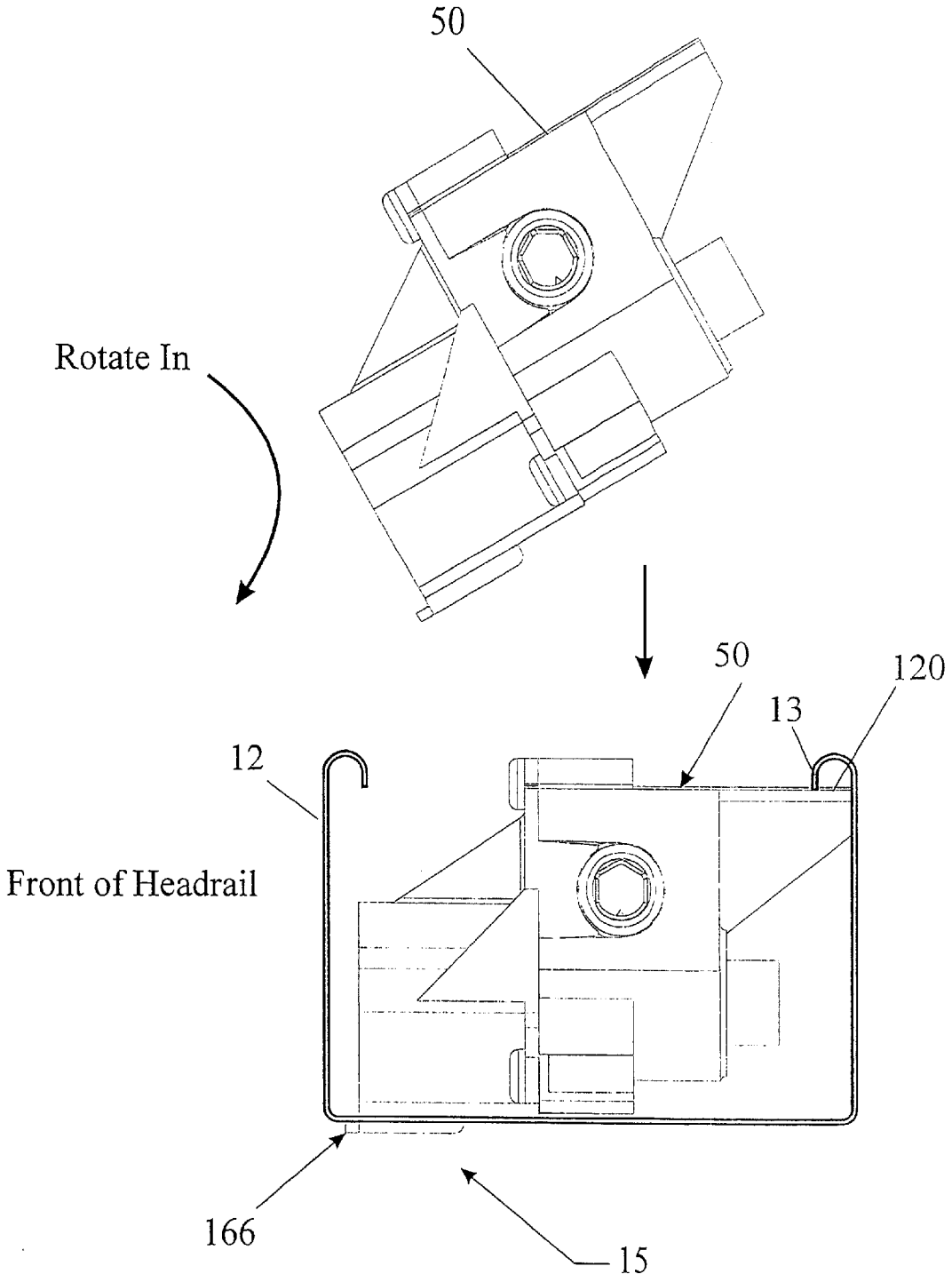
FIG. 1A is a schematic side view, showing the cord tilter of FIG. 1 being installed into the headrail of FIG. 1.

Located directly above the longitudinal cavity 114 of the housing 100 are two U-shaped slots 118 designed to cooperate with, support, and locate the stub shafts 140 of the spur gear 102 onto the housing 100. As shown in FIGS. 1 and 1A, the anvil-shaped projection 120 on top of the housing 100 is designed to snap in under a lip 13 on the profile of the head rail 12, in order to mount the cord tilter mechanism onto the head rail 12. Also, a forwardly-projecting tab 166 on the bottom of the cord tilter 50 passes through a rout hole 15 in the bottom of the headrail 12 and projects underneath the bottom of the headrail 12. In order to install the cord tilter 50 onto the head rail 12, the cord tilter 50 is inserted downwardly and is rotated as shown by the arrows in FIG. 1A until the tab 166 extends below the bottom of the head rail 12, and the projection 120 snaps under the lip 13 adjacent to the top of the head rail 12.

The worm gear 104 has integrally-formed stub shafts 130, 130A at its ends. Projecting from the stub shaft 130A, beyond a shoulder 134, is a smaller diameter shaft extension 132 having a non-circular (in this embodiment hexagonal) profile and an annular detent or slight indentation 136 near the end of the shaft extension 132. The purpose of the detent 136 will be explained later.

Figure 10:
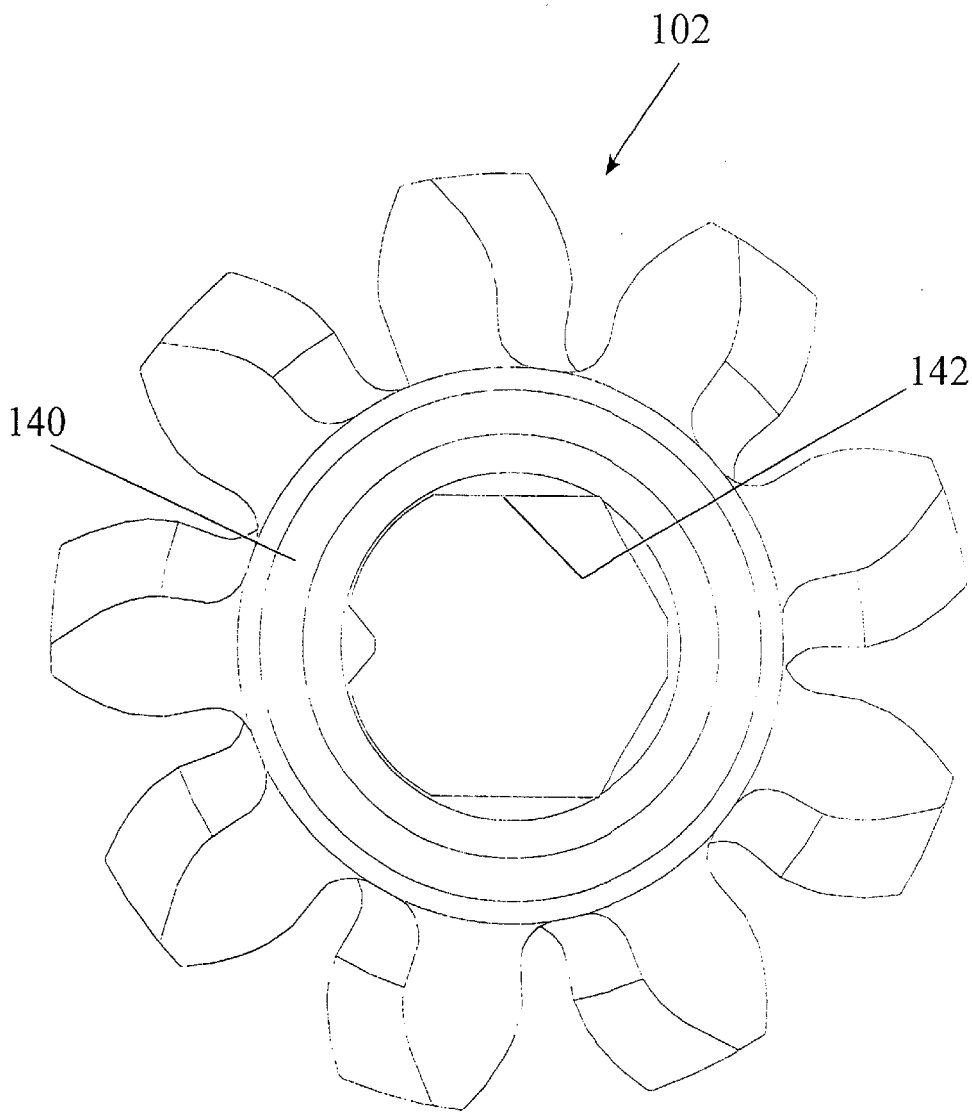
FIG. 10 is an end view of the spur gear of FIG. 6.

Referring briefly to FIG. 10, the spur gear 102 has a hollow shaft 142 and has an interior surface with a non-circular profile, which receives the tilt rod 20 (See FIG. 1) such that rotational movement of the spur gear 102 causes the tilt rod 20 to rotate, and the tilt rod 20, in turn, extends through and rotates the tilt modules 60.

Figure 4A:
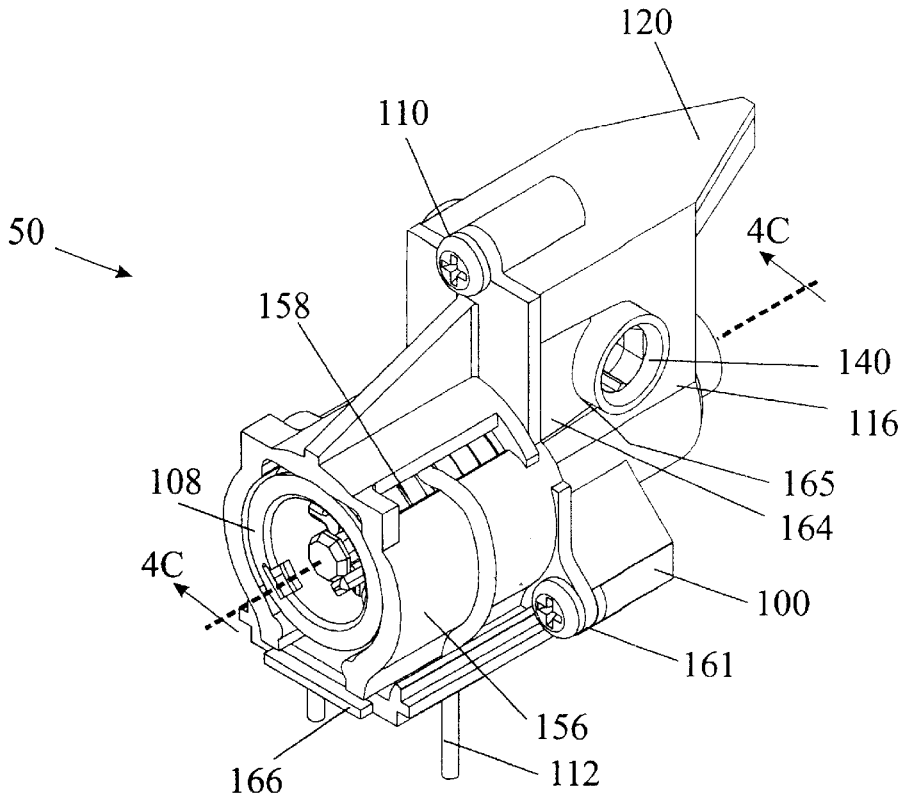
FIG. 4A is a front perspective view of the cord tilter of FIG. 4.
Figure 4B:
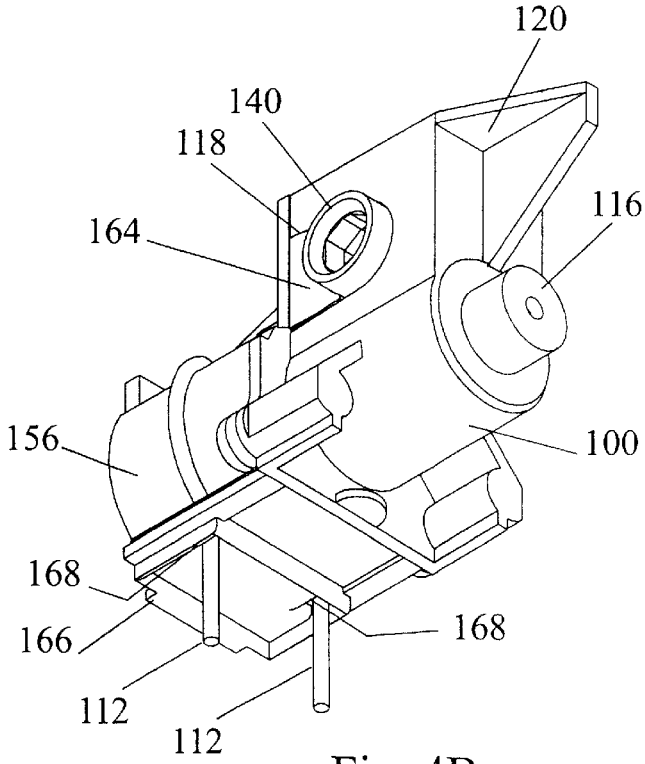
FIG. 4B is a rear perspective view of the cord tilter of FIG. 4A.
Figure 4C:
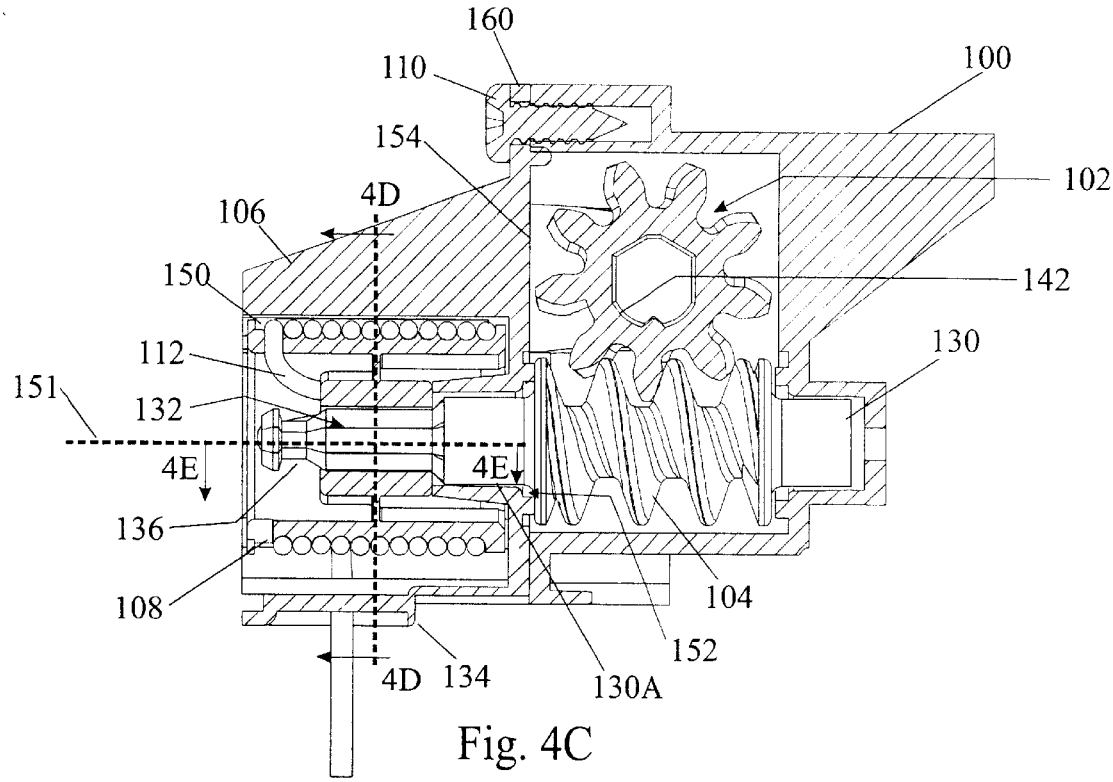
FIG. 4C is a view taken along the section 4C—4C of FIG. 4A.
Figure 9:
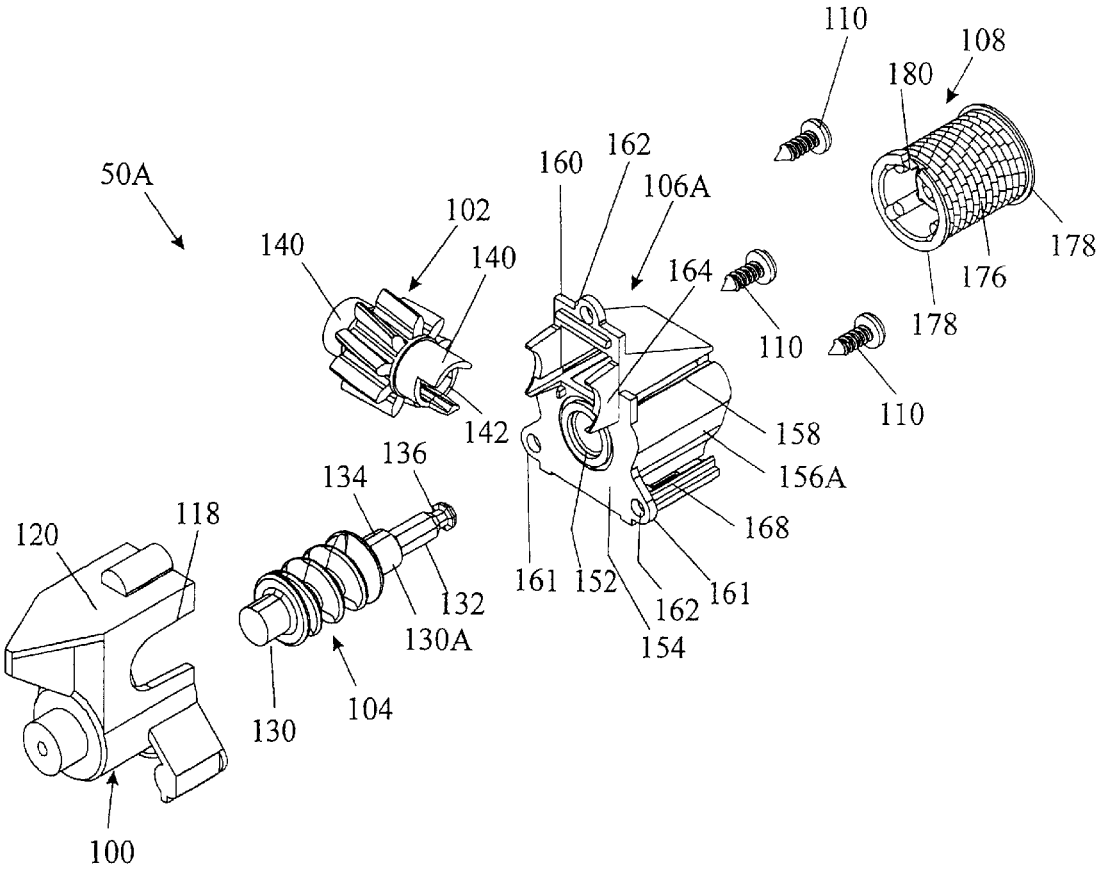
FIG. 9 is an exploded rear perspective view of the cord tilter of FIG. 7.

The housing cover 106 has a substantially cylindrical interior shape. The purpose of the housing cover 106 is not only to support and hold the worm gear 104 and the spur gear 102 in place, but also to receive the threaded drum 108, thus providing tight tolerances between the drum 108 and the housing cover 106. The housing cover 106 defines a longitudinal, substantially cylindrical drum-receiving cavity 150, at least a portion of which has an inside radius just slightly larger than the combined radius of the threaded drum 108 and the diameter of the cord 112 wrapped onto the drum 108. Thus, when the drum 108, with the cord 112 wrapped onto it, is inserted into this housing cover cavity 150, the clearance between the cord 112 and the inside surface of this cavity 150 is on the order of between 0.1 and 0.6 tilt cord diameters. The front end of the cylindrical cavity 150 is totally open to allow the introduction of the drum 108 into the cavity 150. The rear of the cavity is closed except for a small opening 152 (See FIGS. 4C and 9) which receives and supports the stub portion 130A of the worm gear 104. The worm gear shaft extension 132 extends into the cavity 150 and serves as the axle, which supports and is driven by the drum 108. The worm gear 104 and the drum 108 rotate about an axis of rotation 151, shown in FIG. 4C. The rear wall 154 of the housing cover 106 butts up against the front of the housing 100.

For purposes of this discussion, with the drive 50 oriented as shown in FIG. 5, we will assume an imaginary vertical plane 153 including the axis of rotation 151, and a first imaginary horizontal plane 159, which is perpendicular to the vertical plane 153 and tangent to the drum 108. We will also assume a second imaginary horizontal plane 157, including the axis 151, this second imaginary horizontal plane 157 lying parallel to the first horizontal plane 159 and perpendicular to the vertical plane 153. The vertical plane 153, which includes the axis 151, divides the drive 50 into left and right portions, and the horizontal plane 157, which includes the axis 151, divides the drive 50 into upper and lower portions. While the orientation of the drive 50 shown in these drawings is preferred for use in a Venetian blind, the drive 50 may be oriented in other directions, so that its imaginary horizontal and vertical planes need not always be oriented in the horizontal and vertical directions when the drive 50 is installed.

Figure 4D:
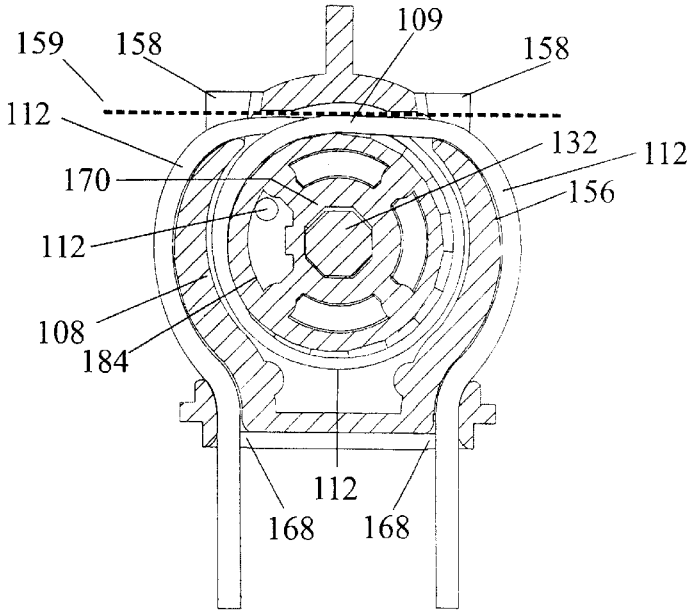
FIG. 4D is a view taken along the section 4D—4D of FIG. 4C.

The rounded side walls 156 of the cavity 150 define upper left and upper right opposed slotted openings 158 lying along the imaginary tangent plane 159 at a height corresponding to the top side of the drum 108 and at approximately the 1:00 o'clock and the 11:00 o'clock positions (as seen from the front end view, FIG. 5), to act as exit slots for the ends of the cord 112. The cord ends 112 pass into the drum-receiving chamber 150 through those respective slots 158. These slotted openings 158 extend for substantially the length of the drum 108 and lie along the imaginary horizontal plane 159 that is substantially tangent to the top of the drum 108, as shown in FIGS. 4D and 5. Both of the cord ends 112 leave the drum 108 at approximately the top center 109. On the upper part of the housing cover 106 there is a mounting flange 160 with a hole 162 through which the screw fastener 110 passes in order to secure the housing cover 106 to the housing 100. There are two opposed, rearwardly-extending arms 164, each having a curved edge 165. When the housing cover is assembled to the housing, these arms 164 enter the open ends of the U-shaped openings 118 of the housing 100 so that, together with the U-shaped openings, they form substantially circular enclosures for the stub shafts 140 of the spur gear 102 in order to support, secure and axially locate the spur gear 102 relative to the cord tilter mechanism 50. The housing cover 106 has two additional mounting flanges 161 with holes 162 through which screw fasteners 110 pass in order to secure the housing cover 106 to the housing 100, and it has a forwardly-projecting bottom lip 166 which is used to snap the cord tilter mechanism 50 into the head rail 12. Finally, the housing cover 106 has left and right lower openings 168 along its base. These lower openings 168 act as a guide to lead the ends of the cord 112 through the head rail as shown in FIGS. 1, 4, 4A–D, and 5. The lower openings 168 extend in a front-to-rear direction for a distance that is substantially less than the front-to-rear dimension of the upper slots 158. For example, in this particular preferred embodiment, the upper slots 158 extend for ⅝-inch, and the lower openings 168 extend for ⅛-inch in the front-to-rear direction. It is preferred that the upper slots 158 extend at least twice as far and most preferably at least three times as far as the lower openings 168 in the front-to-rear direction.

The worm gear 104 is meshed with the spur gear 102, and the meshed gears 102, 104 are inserted into the housing 100, with the rear stub shaft 130 on the worm gear 104 resting in the recess 116, and the stub shafts 140 of the spur gear 102 resting in the U-shaped openings 118 of the housing 100. The housing cover 106 is assembled to the housing 100. The cord tilter assembly 50 is then held together by the fasteners 110, awaiting the insertion of the drum 108.

The threaded, cord-receiving, outer surface of the drum 108 receives the cord 112, and the drum 108 defines a non-circular (in this case hexagonal) inside surface 170 which mates with the extension 132 of the worm gear 104 so that the shaft extension 132 and the drum 108 rotate together. Projecting forwardly from the wall which forms the inside surface 170 of the drum 108 is a flexible catch arm 172, which has an inwardly-projecting head 174 (See FIG. 4E) which mates with the detent 136 on the shaft extension 132 of the worm gear 104. Once the enlarged head 174 is caught in the detent 136, the threaded drum 108 is held in place and cannot be removed until the catch arm 172 is released. It may be desirable to have two such catch arms 172 located opposite each other, to securely retain the drum 108 on the shaft extension 132.

The outside surface 176 of the drum 108 preferably is threaded to receive the wraps of the cord 112, and there are flanges 178 on both ends of the threaded surface 176. The flanges 178 are as tall as the diameter of the cord 112, and there is a notch 180 in one of the flanges 178, and a hole 182 in the other flange 178, so that the cord 112 may pass from the outer threaded surface 176 to a lengthwise passage 184 (See FIGS. 4C and 4D) running the length of the drum 108, between the outside surface 176 and the inside surface 170 of the drum 108.

Figure 4E:
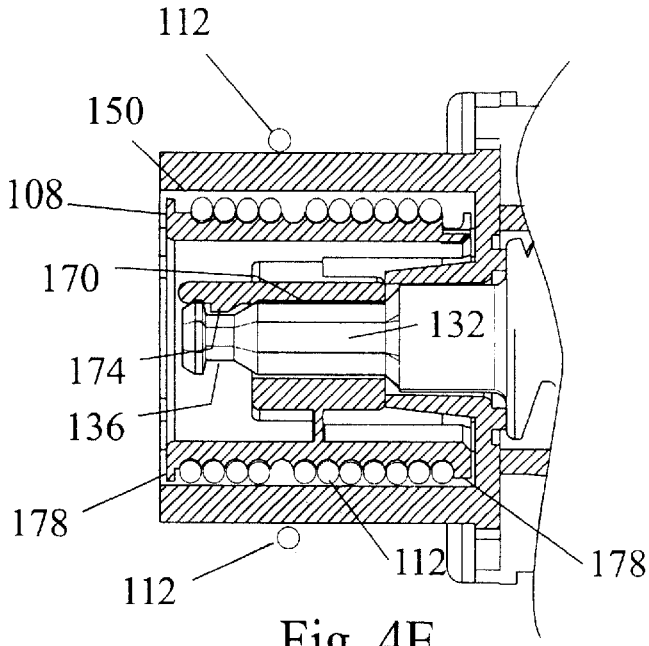
FIG. 4E is a view taken along the section 4E—4E of FIG. 4C.

The cord 112 is wrapped onto the drum 108 as follows: A first end of the cord is drawn through the axially-running passage 184 and is passed through the hole 182 on one of the flanges 178 until the drum 108 is approximately at the midpoint of the cord, and then is started wrapping onto the drum 108 in one direction (for instance, clockwise), from the flange 178 toward the center of the drum 108. The second end of the cord 112 is passed through the notch 180 at the other flange 178, and is also started wrapping onto the drum 108 from the other flange 178 toward the center of the drum in the opposite direction (counterclockwise, in this instance) (See FIGS. 8 and 8A for a view of the cord 112 wrapped onto the drum 108, with the drum removed for clarity). The cord 112 preferably is wound onto the drum 108 until there is only one empty drum thread between the wraps of cord 112 coming together on the threaded surface 176 of the drum 108, as shown in FIG. 4E. The free ends of the cord 112 are then fed through the left and right upper slotted openings 158 of the housing cover 106 such that each end of the cord 112 crosses over the top side of the drum 108 and exits the slotted opening 158 on the opposite side of the drum 108, leaving the top center 109 of the drum in a tangential horizontal direction. With this arrangement, both cord ends leave the drum tangentially at the top of the drum and exit the opposite side, so that the horizontal exit direction of the cord ends from the drum is approximately 90 degrees from the downward direction in which the operator pulls on the cord ends, and the exit point of the cord ends from the drum, at the top center 109 of the drum, is 180 degrees disposed from the downward direction in which the operator applies force to the cord ends. The drum 108 is then inserted into the cavity 150 of the assembled housing 100 and cover 106, with the front end of the drum 108, having the flexible arm 172, facing toward the totally open front side of the housing cover 106. The drum snaps onto the shaft 132 of the worm gear 104. The ends of the cord 112 then drape down along the outside of the rounded walls 156 of the housing cover 106, and are then fed through the left and right lower holes 168 at the base of the housing cover 106 and through the rout hole 15 in the bottom of the head rail 12.

As shown in FIG. 1, the cord tilter module 50 is installed in the head rail 12, and the tilt rod 20 is connected to the cord tilter module 50 by inserting the end of the tilt rod 20 into the non-cylindrical hollow shaft 142 of the spur gear 102. Now, as one end of the tilt cord 112 is pulled, the drum 108 rotates, driving the worm gear 104. The worm gear 104 meshes with the spur gear 102, and causes the spur gear 102 to rotate, which in turn causes the tilt rod 20 to rotate. As the tilt rod 20 rotates, the tilt modules 60 also rotate, pulling one of their respective tilt cables 18 up while the opposite tilt cable 18 falls, thus tilting the slats 14.

The drum 108 has a stationary axis of rotation, which is substantially horizontal, and the ends of the cord 112 exit the drum-receiving chamber in opposite tangential directions and then wrap around the rounded wall 156 of the housing cover 106, making a substantial change in direction, until they hang downwardly from the head rail 12, parallel to each other, extending in a substantially vertical direction.

While the cord-driven drum in this embodiment drives a worm gear and then a spur gear for use in a cord tilter arrangement, it will be understood that the cord-driven drum could drive any number of other mechanical devices through various known means. Also, while the drum 108 preferably has a threaded outer cord-receiving surface, the cord-receiving surface need not be threaded.

A prior art cord tilter is shown in FIGS. 2 and 3. In this prior art design, if the user pulls both ends of the tilt cord 112 simultaneously, both ends of the cord exert a downward component of force on the drum 108, tending to open the clearance gap C1 between the cord 112 and the housing cover 106B at the top of the drum 108. This widening of the gap C1 may create a space wide enough for an additional diameter of cord to fit between the initial wrap of cord and the housing cover, which may allow an over-wrap condition to occur, causing a locking or jamming of the mechanism, or, in any event, a higher resistance to the smooth turning of the drum 108. At the same time, the same downward component of force exerted on the drum 108 also tends to narrow the clearance gap C2 between the cord 112 and the housing cover 106B at the bottom of the drum 108. This narrowing of the gap C2 may cause the cord 112 to be pinched against the housing cover 106B, causing more resistance to the smooth turning of the drum 108 and, once again, possibly locking up the mechanism. While some downward component of force is present even when the user pulls only on one of the tilt cord 112 ends, pulling both ends simultaneously causes the downward components to add together, creating a substantial downward force on the drum.

Referring now to FIGS. 4 and 5, showing an embodiment of the present invention, when the user pulls downwardly on either end of the tilt cord 112, the housing cover 106 supports the downward component of the force, and only a horizontal component of force is transmitted by the cord 112 to the drum 108. Furthermore, since the cord ends 112 leave the drum 108 simultaneously in opposite tangential left and right horizontal directions, if both cord ends 112 are pulled simultaneously, the horizontal component of force imparted onto the drum 108 in one direction by one cord end 112 is cancelled by the horizontal component of force imparted onto the drum 108 in the opposite direction by the other end of the cord 112, so that only the portion of the horizontal component of force exerted on one cord end which exceeds the horizontal component of force from the other cord end actually causes any movement of the drum 108 relative to its housing. Also, the movement that will be caused by that force component is rotation of the drum rather than deflection of the drum.

With the downward component of force being supported on the housing 106, and the horizontal components of force largely canceling each other in the event that both ends of the cord 112 are pulled simultaneously, the drum 108 always remains centered in the housing cover 106, with no substantial change in the clearance gaps all around the drum 108. Thus, the clearance gaps between the cord 112 wrapped on the drum 108 and the housing cover 106 can be reduced to the range of between 0.1 and 0.6 cord diameters without any concern that the cord will be pinched between the drum 108 and the housing cover 106. In other words, the gap between the housing and the drum can be reduced to the range of between 1.1 and 1.6 cord diameters. (While these reduced gaps are preferred, the gap between the housing and the drum should at least be less than two cord diameters.) This narrowing of the clearance gaps enhances the tracking of the cord 112 onto the drum 108, even in the absence of guiding threads 176 on the surface of the drum 108, and even in conditions where the cord 112 may become completely relaxed.

Figure 7:
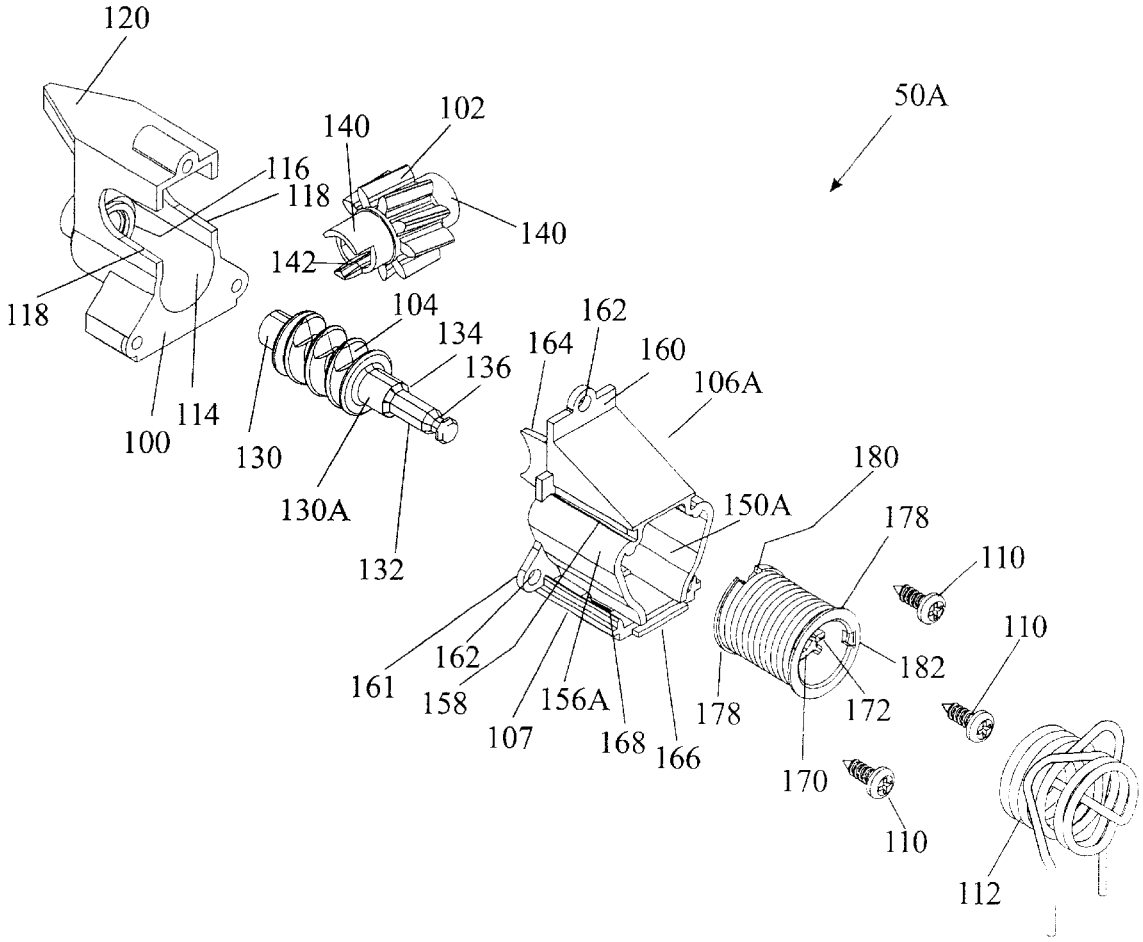
FIG. 7 is an exploded front perspective view of a second embodiment of an improved cord tilter made in accordance with the present invention.

FIG. 7 shows a second embodiment of a cord tilter 50A made in accordance with the present invention. This embodiment is identical to the first embodiment of the cord tilter 50 except for the shape of the housing cover 106A. This housing cover 106A still has a substantially cylindrical profile, but, in this case, it is more heart-shaped than is the more cylindrical profile of the housing cover 106 of the first embodiment of the cord tilter 50. This heart-shaped profile may provide a smoother transition for the tilt cords 112 around the outer wall 156A of housing cover 106A. The principle of operation of this second embodiment 50A is identical to that already described for the first embodiment 50, with at least a portion of the housing cover 106A providing a small enough clearance to prevent over-wrap and help guide the cord 112 onto the drum 108.

Both the outer surface of the wall 156 of the first embodiment and the outer surface of the wall 156A of the second embodiment provide a surface on the outside of the drum-receiving chamber 150, 150A along which the cord ends 112 track between the left and right lower holes 168 and the respective left and right upper slots 158. This permits the cord ends 112 to enter the drum at an angle that is closer to perpendicular to the axis of rotation than would be the case if the cord had to pass directly from the openings 168 onto the drum, especially at the ends of the drum. (The lower holes 168 are at approximately the center of the length of the drum in this preferred embodiment, so the angle at which the cord ends 112 approach the drum 108 is more nearly perpendicular to the axis of rotation at the center of the drum.)

Figure 8:
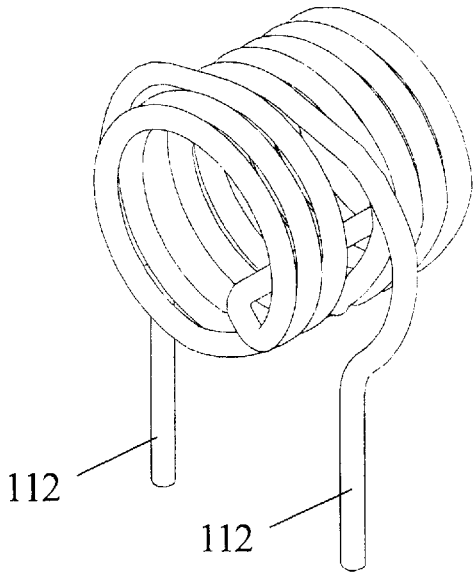
FIG. 8 is a enlarged front perspective view of the cord wrap of FIG. 6.
Figure 8A:
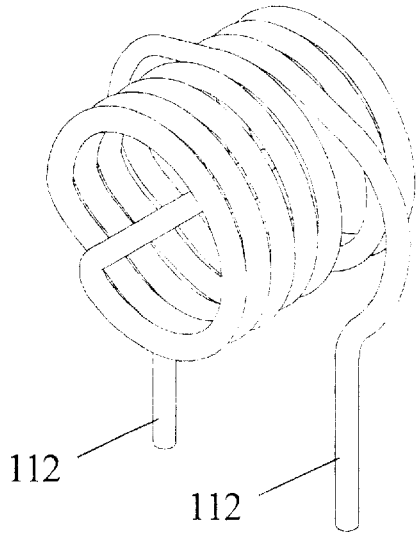
FIG. 8A is the same view as FIG. 8 but with the drum rotated to a different position.

FIG. 8 shows the positions of the cord ends 112 when the drum has rotated all the way in a first direction, wrapping the right cord end onto the drum. Then, the right cord end is pulled, causing the right cord end to unwind and the left cord end to wind up, reaching the position of FIG. 8A. From that position, the left cord end 112 would be pulled, winding up the right cord end and unwinding the left cord end, until the cord returns to the position of FIG. 8. In moving from the position of FIG. 8 to the position of FIG. 8A, the cord ends traverse their respective slots 158, with the cord ends 112 exiting the drum-receiving chamber 150 near the front of the chamber in FIG. 8 and near the rear of the chamber in FIG. 8A.

The embodiments of the invention described above are simply two examples of preferred drives made in accordance with the present invention. It will be obvious to those skilled in the art that modifications may be made to the embodiments described above without departing from the scope of the present invention.

What is claimed is:

1. A cord-actuated drive, comprising:

a drum having a substantially cylindrical cord-receiving surface and defining a length and an axis of rotation;

first and second cord end portions counter-wrapped around said cord-receiving surface; and a drum housing defining a drum-receiving chamber which at least partially encloses said drum, and defining a rounded outer surface, wherein said housing defines first and second opposed openings into said drum-receiving chamber lying substantially along a first imaginary plane that is tangent to said cord-receiving surface; said first and second opposed openings being elongated in a direction substantially parallel to said axis of rotation;

wherein a portion of said first imaginary plane passes through said first and second opposed openings and through said drum-receiving chamber; and wherein said first and second cord end portions exit said drum receiving chamber in opposite directions, through said first and second opposed openings, respectively, with at least said first cord end portion wrapping around said rounded outer surface of said housing and making a substantial change in direction as it exits its respective opening.

2. A cord-actuated drive as recited in claim 1, wherein said first and second openings are first and second elongated slots extending for substantially the full length of said drum and lying substantially parallel to said axis of rotation, and wherein a second imaginary plane, lying parallel to said first imaginary plane and including the axis of rotation of said drum divides the drum and housing into first and second portions, with said first and second parallel elongated slots lying in the first portion of said housing.

3. A cord-actuated drive as recited in claim 2, and further comprising a third imaginary plane including said axis of rotation and lying perpendicular to said first and second imaginary planes, with said first elongated slot lying on one side and said second elongated slot lying on the other side of said third imaginary plane.

4. A cord-actuated drive as recited in claim 1, wherein said axis of rotation is stationary and substantially horizontal, and said first and second cord end portions hang downwardly from said drum housing in a substantially vertical direction.

5. A cord-actuated drive as recited in claim 4, wherein said second cord end portion also wraps around the rounded outer surface of said housing.

6. A cord-actuated drive as recited in claim 1, wherein said housing includes a base which defines first and second holes through which said first and second cord ends pass, and said first and second cord ends lie substantially parallel to each other as they pass through said first and second holes.

7. A cord-actuated drive, comprising:

a drum having a substantially cylindrical cord-receiving surface and defining a length and an axis of rotation; and a drum housing defining a drum-receiving chamber which at least partially encloses said drum, wherein said housing defines first and second opposed openings into said drum-receiving chamber lying substantially along a first imaginary plane that is tangent to said cord-receiving surface; said first and second opposed openings being elongated slots extending for substantially the full length of said drum and lying substantially parallel to said axis of rotation, and wherein a second imaginary plane, lying parallel to said first imaginary plane and including the axis of rotation of said drum divides the drum and housing into first and second portions, with said first and second parallel elongated slots lying in the first portion of said housing; and further comprising a third imaginary plane including said axis of rotation and lying perpendicular to said first and second imaginary planes, with said first elongated slot lying on one side and said second elongated slot lying on the other side of said third imaginary plane;

and further comprising first and second cord end portions counterwrapped onto said cord-receiving surface, wherein said first and second cord end portions exit the drum substantially along said first imaginary tangent plane, exiting in opposite directions through their respective slots, so that, when both said first and second cord end portion are pulled, they exert force on the drum in substantially opposite directions so as to offset each other; and wherein said housing further includes a base portion on the opposite side of said drum from said first tangent plane, and further comprising first and second holes through said base portion outside of said drum-receiving chamber through which first and second cord end portions respectively pass.

8. A cord-actuated drive as recited in claim 7, wherein the sections of said cord end portions which have passed through said holes in said base portion lie substantially parallel to each other.

9. A cord tilter module for window covering products, comprising:

a driving drum;

first and second cord ends counter-wrapped around said driving drum; and a housing defining a drum-receiving chamber at least partially encasing said driving drum, and having a rounded outer surface, wherein said first and second cord ends exit from said driving drum in opposite tangential directions, and wherein said housing has opposed first and second exit openings lying in said opposite tangential directions to guide said first and second cord ends out of said drum-receiving chamber, with at least one of said cord ends wrapping around said rounded outer surface and making a substantial change in direction as it exits said drum-receiving chamber.

10. A cord tilter module as recited in claim 9, wherein said driving drum is threaded to guide wrapping of said cord ends.

11. A cord tilter module as recited in claim 9, wherein said cord has a diameter, said drum-receiving chamber of said housing has an inner surface, and said drum defines a substantially cylindrical cord-receiving surface, and wherein said housing defines a clearance between said inner surface of said housing and said cord-receiving surface of said driving drum, of less than two diameters of said cord.

12. A cord tilter module as recited in claim 11, wherein said clearance is between 1.1 and 1.6 cord diameters.

13. A cord tilter module as recited in claim 9, wherein said second cord end also wraps around said rounded outer surface as it leaves its respective exit opening.

14. A cord tilter module as recited in claim 13, wherein said driving drum has a stationary axis of rotation which is substantially horizontal, and wherein substantial sections of said cord ends outside of said drum-receiving chamber hang downwardly.

15. A cord tilter module as recited in claim 9, wherein said driving drum has a substantially threaded outer surface, and said drum-receiving chamber defines an inner surface which has a clearance with said threaded outer circumferential surface of said driving drum of between 1.1 and 1.6 cord diameters.

16. A cord tilter module as recited in claim 9, wherein said driving drum has a substantially cylindrical cord-receiving wall defining a length, an axis of rotation, an internal passageway along its length, a notch at one end of said wall, and an opening at the other end of said wall for receiving and securing a counter-wrapped cord.

17. A cord tilter module for window covering products, comprising:

a driving drum;

first and second cord ends counter-wrapped around said driving drum; and a housing defining a drum-receiving chamber at least partially encasing said driving drum, wherein said first and second cord ends exit from said driving drum in opposite tangential directions, and wherein said housing has opposed first and second exit openings lying in said opposite tangential directions to guide said first and second cord ends out of said drum-receiving chamber, and further comprising a worm gear driven by said driving drum, and a spur gear meshed with said worm gear.

18. A cord actuated drive, comprising:

a driving drum with a substantially cylindrical threaded outer surface;

first and second cord end portions having a diameter and being counter-wrapped around said threaded surface of said driving drum;

a housing defining a drum-receiving chamber at least partially encasing said driving drum, said housing defining opposite first and second exit openings through which said first and second cord ends exit said drum-receiving chamber, wherein said first and second cord ends exit from said driving drum in opposite tangential directions, and further exit said drum-receiving chamber through said opposite first and second exit openings, which lie along said opposite tangential directions, and wherein said drum-receiving chamber defines an inner surface which has a clearance with said threaded outer circumferential surface of said driving drum of between 1.1 and 1.6 cord diameters, and further comprising a worm gear driven by said driving drum, and a spur gear meshed with said worm gear.

19. A cord-actuated drive, comprising:

a housing, having left, right, top, bottom, and front and back sides; said housing including a base portion on its bottom side and a drum-receiving portion mounted on top of said base portion, said drum-receiving portion defining an outer surface and an inner surface;

an axle mounted on said housing for rotation relative to said housing and defining an axis of rotation which extends in the front-to-back direction; and a drum having a length, said drum being mounted on said axle and inside said drum-receiving portion of said housing, said drum defining a substantially cylindrical cord-receiving outer surface;

wherein said housing defines a plurality of holes for guiding a cord through said base and into said drum-receiving portion, including:

a first elongated slot through the upper left portion of said drum-receiving portion, extending in the front-to-back direction for substantially the length of said drum;

a second elongated slot through the upper right portion of said drum-receiving portion, extending in the front-to-back direction for substantially the length of said drum;

a third hole through said base, outside of said drum-receiving portion and on the left side of said housing, said third hole having a length in the front-to-back direction less than half the length of said first elongated slot; and a fourth hole through said base, outside of said drum-receiving portion and on the right side of said housing, said fourth hole having a length in the front-to-back direction less than half the length of said second elongated slot.

20. A cord-actuated drive as recited in claim 19, wherein said cord-receiving outer surface of said drum is threaded.

21. A cord-actuated drive as recited in claim 19, and further comprising first and second cord ends, wherein said first cord end extends upwardly through said third hole, along the outer surface of said drum-receiving chamber, then through said first slot into the drum-receiving chamber, then across the top of said drum, and wraps around said drum, and wherein said second cord end extends upwardly through said fourth hole, along the outer surface of said drum-receiving chamber, then through said second slot into the drum-receiving chamber, then across the top of said drum, and wraps around said drum.

22. A cord-actuated drive as recited in claim 21, wherein both said first and second slots are substantially aligned with the top of said drum so that said first and second cord ends both contact said drum at approximately the top of the drum.

23. A cord-actuated drive as recited in claim 21, wherein the outer surface of said drum-receiving chamber is curved in order to provide a smooth, curved surface over which said cord ends pass from their respective slot to their respective hole.

24. A blind assembly for covering an architectural opening, comprising:

a horizontal head rail;

a blind suspended from said head rail; and a cord-actuated drive mounted on the head rail, including a drum having a substantially cylindrical cord-receiving surface and defining a length and a substantially horizontal axis of rotation;

first and second cord end portions counter-wrapped around said cord-receiving surface; and a drum housing having an outer surface and an inner surface and defining a drum-receiving chamber which at least partially encloses said drum, wherein said housing defines first and second opposed openings into said drum-receiving chamber lying substantially along a first imaginary plane that is tangent to said cord-receiving surface; said first and second opposed openings being elongated in a direction substantially parallel to said axis of rotation;

wherein said first and second cord end portions exit said drum receiving chamber in opposite directions, through said first and second opposed openings, respectively, with at least said first cord end portion making a substantial change in direction as it exits its respective opening, and with both said first and second cord end portions extending vertically downwardly from said head rail.

25. A cord-actuated drive, comprising:

a drum having a substantially cylindrical cord-receiving surface and defining a length and a stationary horizontal axis of rotation;

a drum housing defining a drum-receiving chamber which at least partially encloses said drum;

first end second cord end portions counterwrapped onto said cord-receiving surface, wherein said first and second cord end portions exit the drum and the drum-receiving chamber in opposite tangent directions, lying substantially along an imaginary plane parallel to said axis of rotation and tangent to said cord-receiving surface, and wherein said first end second cord end portions have first and second downwardly-hanging free ends, respectively, such that at least said first cord end portion makes a substantial change in direction from the direction in which it leaves said drum-receiving chamber to the downwardly-hanging direction of said first free end; and a first cord supporting surface located outside of said drum-receiving chamber and supporting said first cord end portion as it makes said substantial change in direction from said tangent direction to said downwardly-hanging direction, so that pulling downwardly on both of said free ends at the same time generates opposing rotational forces on said drum and generates a force that is supported by said cord supporting surface but does not generate a force tending to deflect said drum downwardly.

26. A cord-actuated drive as recited in claim 25, wherein both of said first and second cord end portions make a substantial change in direction from the direction in which they leave said drum-receiving chamber to the downwardly-hanging directions of said first and second free ends, respectively, and further comprising a second cord supporting surface located outside of said drum-receiving chamber and supporting said second cord end portion as it makes said substantial change in direction.

27. A cord-actuated drive as recited in claim 25, wherein said drum housing has a rounded outer surface, and at least said first cord end wraps around said rounded outer surface and makes a substantial change in direction as it leaves said drum-receiving chamber, and said first and second cord ends hang vertically downwardly from said housing.

28. A cord-actuated drive as recited in claim 27, wherein said second cord end portion also wraps around said rounded outer surface of said housing and makes a substantial change in direction as it leaves said drum-receiving chamber.

* * * * *